United States Patent [19]

Odekirk

[11] Patent Number: 4,766,918

[45] Date of Patent: Aug. 30, 1988

[54] CONVERTIBLE, INFLATABLE SHELTER APPARATUS

[75] Inventor: W. G. Odekirk, Las Vegas, Nev.

[73] Assignee: Aspen Enterprises, Inc., Las Vegas, Nev.

[21] Appl. No.: 926,902

[22] Filed: Nov. 3, 1986

[51] Int. Cl.[4] ..... E04H 15/02; E04H 15/36; B63B 35/58; E04B 1/34

[52] U.S. Cl. ..... 135/96; 135/102; 135/106; 135/90; 52/2; 5/81 R; 441/38; 114/345

[58] Field of Search ..... 135/106, 90, 103, 104, 135/102, 96, 118, 117, 120, 98; 52/2; 5/81 R, 82 R, 413, 416; 441/38, 40; 114/345, 349

[56] References Cited

U.S. PATENT DOCUMENTS

| | | | |
|---|---|---|---|
| 1,392,533 | 10/1921 | Smyth | 114/345 |
| 2,314,057 | 3/1943 | Slotsky et al. | 446/163 |
| 2,804,633 | 9/1957 | Taylor et al. | 52/2 J X |
| 2,938,524 | 5/1960 | Benson | 135/118 X |
| 3,058,127 | 10/1962 | Hassold | 441/38 |
| 3,092,854 | 6/1963 | Manhart | 441/38 |
| 3,131,406 | 5/1964 | Cousteau et al. | 441/38 |
| 3,534,750 | 10/1970 | Kolozsvary | 135/905 X |
| 3,751,741 | 8/1973 | Hendry | 5/416 |
| 3,834,410 | 9/1974 | Leibel | 135/905 X |
| 4,000,585 | 1/1977 | Denaro | 135/118 X |
| 4,000,749 | 1/1977 | Busco | 52/2 G X |
| 4,063,320 | 12/1977 | Neumann et al. | 114/345 |
| 4,222,400 | 9/1980 | Reimer | 135/88 |
| 4,251,959 | 2/1981 | Hsu | 135/104 X |
| 4,269,210 | 5/1981 | Marks | 135/104 |

FOREIGN PATENT DOCUMENTS

| | | | |
|---|---|---|---|
| 0067070 | 12/1982 | European Pat. Off. | 5/82 R |
| 2481589 | 11/1981 | France | 5/413 |
| 8203001 | 9/1982 | PCT Int'l Appl. | 135/103 |
| 197712 | 12/1977 | Switzerland | 135/116 |

*Primary Examiner*—Robert A. Hafer
*Attorney, Agent, or Firm*—Sheldon & Mak

[57] ABSTRACT

A convertible, collapsible shelter apparatus for use on land and in a body of water comprises a buoyant vehicle in combination with a shelter assembly. The buoyant vehicle has (a) an inflatable frame, (b) a flexible member whose perimeter is sealingly attached to the frame, and (c) anchors for holding a spaced plurality of pole members. The shelter assembly has (a) a plurality of struts which are removably held by the anchors and extend upwardly therefrom and across the floor, (b) a flexible cover supported by the struts and which extends to proximate the perimeter of floor and has an entrance for an occupant of the shelter; (c) an inflatable cushion which covers the frame and is removably retained against the floor by the frame, and (d) fasteners for holding a bottom portion of the cover proximate an edge of the cushion. When the cushion, the struts, and the cover are removed from the vehicle to form a tent, the fasteners are capable of maintaining the cover proximate the cushion. The device greatly reduces the amount of gear required to participate in boating, camping, and aquatic activities.

22 Claims, 2 Drawing Sheets

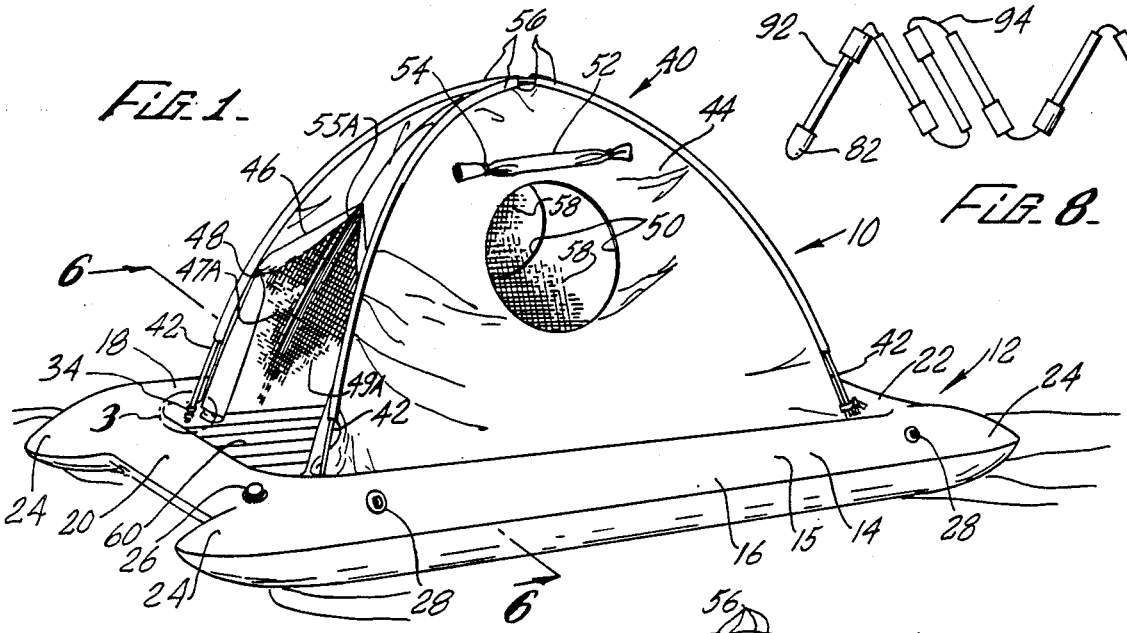
FIG. 1.
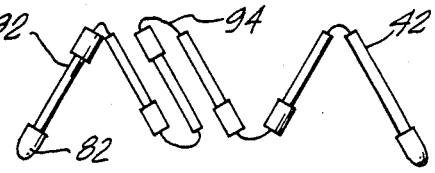
FIG. 8.
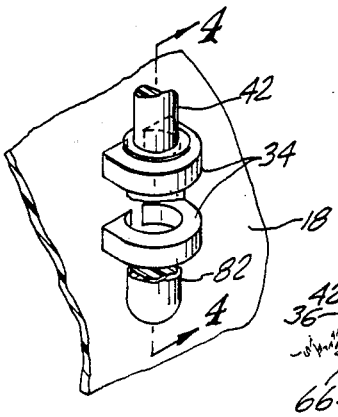
FIG. 3.
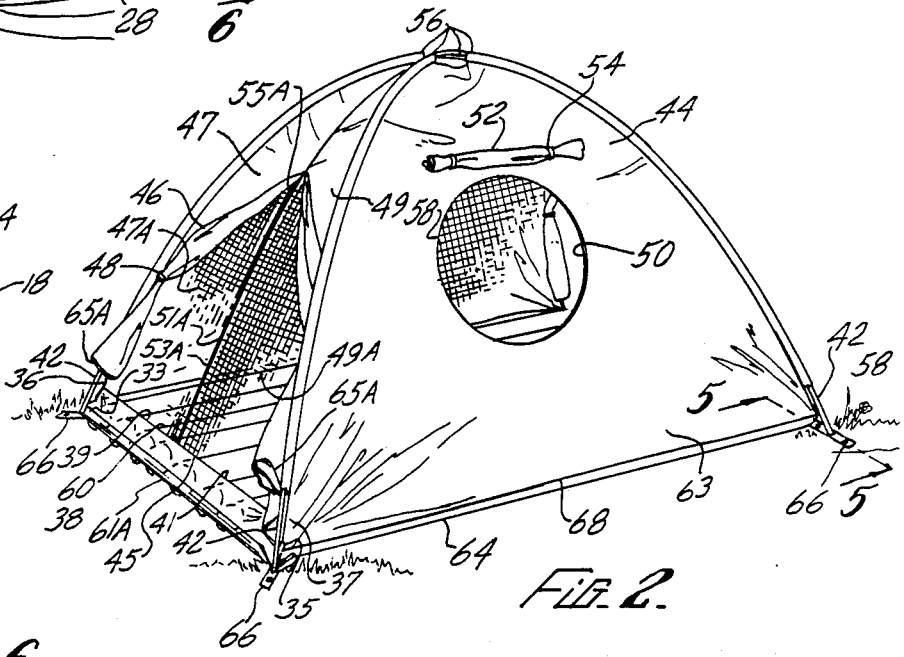
FIG. 2.
FIG. 6.
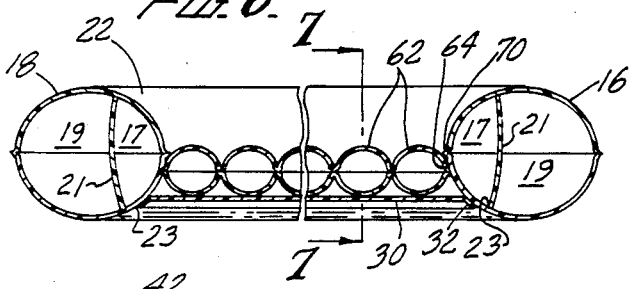
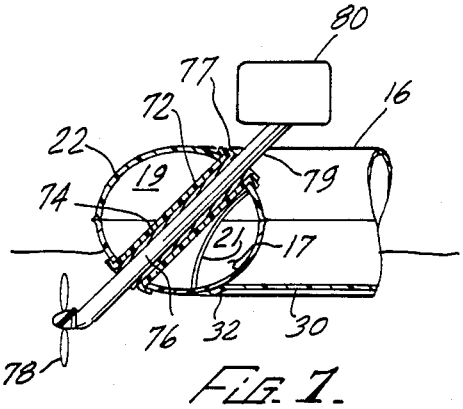
FIG. 7.
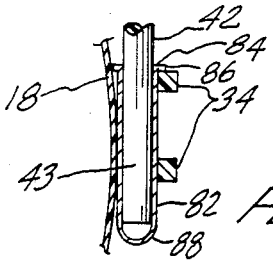
FIG. 4.
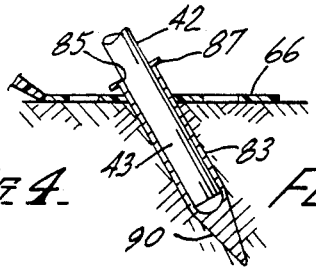
FIG. 5.

CONVERTIBLE, INFLATABLE SHELTER APPARATUS

BACKGROUND

The present invention is directed to a convertible, collapsible, shelter apparatus and, in particular, to a device that can be converted for use as a houseboat, a tent, and an air mattress.

Recreation is becoming a more important factor in the lives of individuals. Boating, camping, and water sports are just a few of the many recreational activities enjoyed by many people. However, one of the frustrations involved in undertaking diverse recreational activities is the burdensome amount of gear required. For example, if one wants to go boating on a river or lake and have the option to either sleep on the boat or on land, one needs a boat having an attached shelter as well as a tent for use on land. In addition, if one wishes to take a plunge in the water and relax on a raft, one also needs an air cushion.

Accordingly, there is a need for a shelter apparatus that reduces the amount of gear required for boating, camping, and aquatic recreational activities.

SUMMARY

The convertible, collapsible shelter apparatus of the present invention satisfies this need. This apparatus can be used as a houseboat on water, converted for use as a tent supported on land, and can also be converted for use as an air cushion. Accordingly, the ability to selectively use various combinations of the components of the apparatus of the present invention greatly reduces the amount of gear required in order to comfortably enjoy recreational activities combining camping, boating, and water activities. More particularly, the apparatus comprises a buoyant vehicle in combination with a collapsible shelter assembly. The buoyant vehicle has (a) an inflatable frame comprising an outer member; (b) a flexible member forming a floor for the vehicle; and (c) anchor means on the frame for holding a spaced plurality of pole members. The flexible member has a perimeter which is sealingly attached to the frame.

The shelter assembly comprises (a) a plurality of struts that are removably held by the anchor means and which extend upward therefrom and across the floor; (b) a flexible cover supported by the struts and extending to proximate the perimeter of the floor; (c) an inflatable cushion for covering the floor; and (d) means for holding a bottom portion of the cover proximate an edge of the cushion. The cover has entrance means for an occupant of the shelter and the cushion is removably retained against the floor by the frame.

When the cushion, the struts, and the cover are removed from the vehicle, the holding means is capable of maintaining the cover proximate the cushion. The cushion and struts are capable of being supported on land.

The holding means can include either (a) means for securing the pole members proximate the cushion; (b) means for fastening at least a portion of the edge of the cushion to a corresponding portion of a bottom edge of the cover; or (c) both. When the holding means comprises the pole member securing means and when the cushion is retained by the frame, the pole member securing means is located proximate the anchor means. A zipper and a velcro fastener are exemplary of the fastening means. The zipper or velcro fastener has a first side member attached along a portion of the edge of the cushion and a complimentary side member attached to a corresponding portion of the bottom edge of the cover. The zipper, velcro fastener, or combinations thereof can be located along one or more longitudinal and/or lateral edges of the cushion.

For ease of handling and storage, each strut preferably comprises a plurality of tubular segments, wherein the ends of adjacent segments are removably and telescopically joined, and an elastic cord for biasing the segments axially together. The cord is fixed to opposite ends of the strut and passes through the segments.

The cover preferably comprises at least one channel for insertion of a strut therein for confining the strut in alignment with the cover. It is preferred that the cover have at least one window therein and means for removably covering the window. It is also preferred that the entrance means of the cover comprise two flaps, the apparatus including means for holding corresponding edges of the flaps proximate one another for securing the entrance means closed. In addition, the cover also preferably comprises means for directing water run-off from the cover to a location exterior to the outer member of the inflatable frame for excluding the water from the interior of the vehicle.

The inflatable frame preferably has a rectangular shape because of the use of the apparatus as a houseboat. In this embodiment, the outer member of the frame has a pair of longitudinal sides and a pair of lateral sides. The outer member is preferably cylindrical for efficient hydrodynamics. In addition, portions of each longitudinal side preferably extend beyond the lateral sides of the frame to form conical protrusions which also imparts improved hydrodynamics.

The frame optionally comprises a sleeve member adapted for insertion of an elongated member therethrough. This sleeve member extends through the frame and is sealingly joined thereto. The sleeve member fits tightly around the elongated member. In addition, the outer member of the frame preferably comprises two circumferential compartments. This dual compartment configuration reduces the chance of the boat sinking in the event the frame gets punctured.

The present invention also provides a method for providing shelter on land and in a body of water. More particularly, this method comprises the steps of (a) selecting the above described buoyant vehicle; (b) inserting the inflatable cushion into the vehicle to cover the floor thereof; (c) inserting one end of a plurality of struts into the anchor means for use as pole members; (d) attaching the flexible cover to the struts; (e) extending an opposite end of each strut across the floor; (f) inserting the opposite end of each strut into the anchor means; (g) securing the bottom portion of the cover proximate the edge of the cushion; (h) removing the cushion, the struts, and the cover from the vehicle; and (i) placing the cushion and struts on the land to thereby form a tent with a bottom portion of the cover secured proximate the edge of the cushion.

Prior to placing the struts on the land, it is preferred that the bottom ends of each strut be inserted into a hollow spike and the struts driven into the ground for anchoring the shelter in place.

DRAWINGS

These and other features, aspects, and advantages of the present invention will become better understood from the following description, appended claims, and accompanying drawings where:

FIG. 1 is an oblique elevational perspective view of a convertible, collapsible apparatus embodying features of the present invention, the apparatus including a shelter assembly and a separable buoyant vehicle;

FIG. 2 is an oblique elevational perspective view of the shelter assembly of the apparatus of FIG. 1 being supported on land;

FIG. 3 is a fragmentary sectional detail view of the apparatus of FIG. 1 showing anchor means within region 3 of FIG. 1;

FIG. 4 is a fragmentary sectional view of the apparatus of FIG. 1 along line 4—4 in FIG. 3;

FIG. 5 is a sectional detail view showing an alternative configuration of the apparatus of FIG. 2 within region 5 of FIG. 2;

FIG. 6 is a fragmentary sectional view of a portion of the apparatus of FIG. 1 along line 6—6 in FIG. 1;

FIG. 7 is a fragmentary sectional view of the apparatus of FIG. 1 along line 7—7 of FIG. 6;

FIG. 8 is a planar view of struts embodying features of the present invention;

DESCRIPTION

Figure 9:
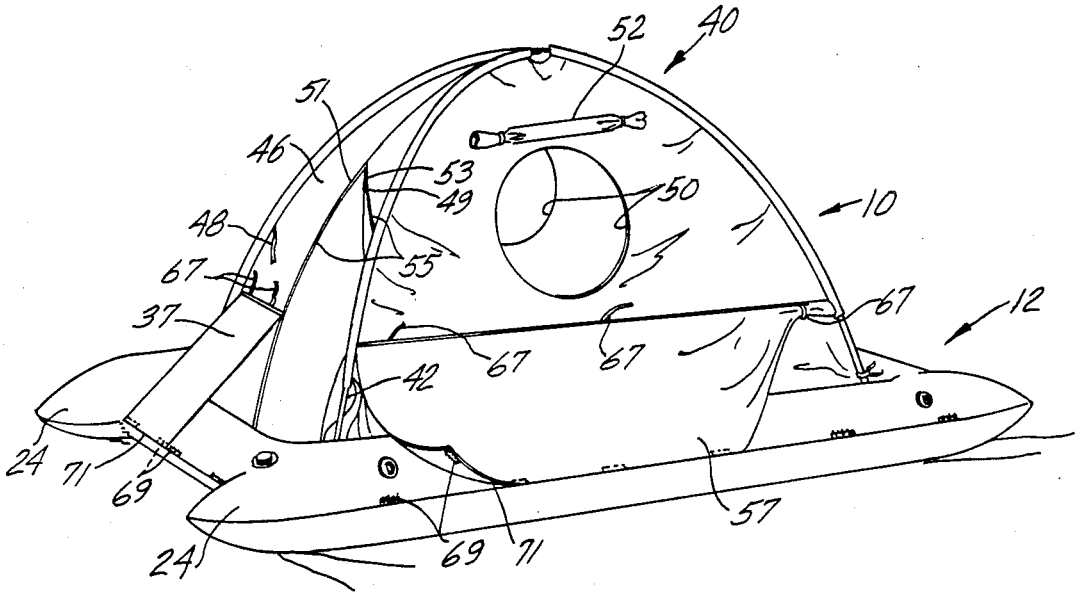
FIG. 9 is an oblique elevational perspective view of an alternative configuration of the apparatus of FIG. 1.

The present invention is directed to a convertible, collapsible shelter apparatus that can be employed as a houseboat, a tent for use on land, and an air mattress. This three-in-one recreational device can be used in recreational activities such as boating, camping, and aquatic past times. Because the components of the present invention can be used in different combinations, the device substantially reduces the amount of gear required in order to participate in these recreational pastimes.

With reference to the Figures, a convertible, collapsible shelter apparatus 10 embodying features of the invention comprises a buoyant vehicle 12 and a shelter assembly 40. The buoyant vehicle 12 has an inflatable frame 14. The inflatable frame 14 has an outer member 15. As a safety precaution, the outer member 15 preferably comprises two circumferential compartments 17 and 19. The circumferential compartments 17 and 19 are separated by a common gas impervious partition 21.

The outer member 15 has any suitable shape such as rectangular, pentagonal, circular, etc. Because of the use of the apparatus 10 as a houseboat, the outer member 15 preferably has a rectangular shape. When rectangular, the frame has a pair of longitudinal sides 16 and 18, and a pair of lateral sides, 20 and 22. Portions of the longitudinal sides 16 and 18 preferably extend beyond the lateral sides 20 and 22. Each such extended portion forms a conical protrusion 24. In this embodiment, the conical protrusions 24 protrude above the water when the buoyant vehicle is in use. The water slides under these protrusions. Accordingly, the buoyant vehicle 12 exhibits less drag and better hydrodynamics. Because of improved hydrodynamics, the outer member 15 of the frame 14 is also preferably cylindrical.

The inflatable frame has one or more a valves 26 provided for independently inflating each compartments in the frame 14. Each valve 26 can be provided with a safety cap. In order to minimize the time required to inflate and deflate the frame 14, each valve 26 preferably is a quick deflation valve. In addition, the frame 14 also has means 28 for attaching a rope or other object to the frame 14. The apparatus 10 can be either towed or moored by attaching one end of a rope to the attaching means 28 and the other end of the rope to a boat or buoy, respectively. The buoyant vehicle also comprises a flexible member 30 (see FIGS. 6 and 7) which forms a floor for the vehicle. Flexible member 30 has a perimeter 32 which is sealingly attached to the frame 14. One edge 23 of the partition 21 is preferably attached to the frame 14 proximate the perimeter 32 of the flexible member 30. The close proximity of the perimeter 32 and the edge 23 of the partition 21 imparts improved stability to the apparatus 10 in the event of a puncture to either compartment. Anchor means 34, shown in FIG. 1 and in detail in FIG. 3, are provided on the frame 14 for holding a spaced plurality of pole members 42.

The frame 14 and flexible member 30 are fabricated from a suitable, sturdy, water impervious material. One such material is polyvinyl chloride (PVC). The thickness of the PVC is chosen to withstand the pressure and loading conditions to which it is exposed during use. A PVC thickness of 20 mil is satisfactory for the frame 12 and a thickness of 22 mil is satisfactory for the flexible member 30. However, for added strength, it is preferred that the frame 12 and the flexible member 30 be constructed from 28 mil thick PVC.

The attachment means 28 and the anchor means 34 are fabricated from a suitable, sturdy material. Plastic is convenient for use as the attachment and anchor means because plastic attachment and anchor means can be molded on the frame 12.

The apparatus 10 also comprises a shelter assembly 40. The assembly 40 has a plurality of struts 42 which comprise the pole members. The struts 42 are removably-held by the anchor means 34 and extend upwardly therefrom and across the floor of the buoyant vehicle 12. Each strut consists of a single member or a plurality of members. Because of ease of handling and storage compactness, each strut preferably comprises (a) a plurality of tubular segments 92 wherein opposite ends of adjacent segments are removably and telescopically joined and (b) an elastic cord 94 for biasing the segments 92 axially together. The cord 94 is fixed to opposite ends of the struts 42 and passes through the segments 92.

A flexible cover 44 is supported by the struts 42. The cover 44 extends to proximate the perimeter of the floor 30 and has entrance means 46 for one or more occupants of the shelter. For convenience of the occupants, the cover 44 is preferably provided with means 48 for maintaining the entrance means 46 in a open position. The entrance means 46 can comprise two flaps, 47 and 49. Preferably, the entrance means 46 further comprises inner mosquito type netting flaps 47A and 49A for excluding insects. The flaps 47, 49, 47A, and 49A have corresponding edges 51, 53, 51A and 53A. Preferably, means 55 and 55A are provided for holding (a) opposing edges 51 and 53 and (b) opposing edges 51A and 53A respectively, proximate one another for securing the entrance means 46 closed. The cover 44 can optionally have a strip 31 with ends 33 and 35 attached to the cover 44 proximate the edge 63 at opposite sides 36 and 37 of each entrance. Preferably, means 38 are provided for holding edges 39 and 41 of the flaps 47A and 49A, respectively, proximate an edge 45 of the strip 35. Exemplary holding means 38, 55, and 55A are zippers and velcro fasteners having a first side member attached along a portion of each edge (a) 39 and 41, (b) 51 and (c) 51A and a complimentary second side member attached to a corresponding portion of each edge (a) 45, (b) 53, and (c) 53A, respectively. In addition, the cover 44 preferably has one or more windows 50 for the viewing pleasure of the occupants. Each window 50 optionally has a means 52 for removably covering it as well as means 54 for securing the covering means 52 in a retracted position.

One or more channels 56 is optionally provided on the cover 44 for insertion of the strut 42 therein. The channels 56 facilitate the stretching of the cover 44 over the struts 42 while maintaining the struts 42 in a predetermined alignment with the cover 44. In addition, the cover 44 preferably has means 58 for maintaining the cover 44 in a stretched condition over the struts 42. The cover 44 also preferably comprises means 57 for directing water run-off from the cover 44 to a location exterior to the outer member 15 of the inflatable frame 14. Each water directing means 57 optionally has means 67 for securing it in a retracted position and means 69 for securing it in an extended position. Velcro fasteners having a first side member attached along a portion of the edge 71 and a complimentary second side attached to a corresponding portion of the outer member 15 are exemplary securing means 69. Another exemplary securing means 69 is a means (not shown) attached to the outer member 15 for holding an elastic cord (not shown) attached to a corresponding portion of the edge 71.

The shelter assembly 40 also comprises an inflatable cushion 60 for covering the floor 30. The cushion 60 has a series of panels 62 wherein all panels are in gas communication with each other. Alternatively, the cushion 60 comprises groups of such series wherein panels 62 of one group are in gas communication with each other but are not in gas communication with panels 62 of any other group. For purposes of inflation and deflation, at least one valve (not shown) is provided in each group of panels 62.

The cushion 60 is removably retained against floor 30 by the frame 14. In order to keep the cushion 60 secured inside frame 14, it is preferred that the cushion 60 be of such thickness that the edges 64, when the cushion 60 is inserted into the vehicle 12, are retained in contact with the frame 14 at a point at or below the midpoint 70 of the frame 14 as well as below the anchor means 34. For the same reason, the cushion 60 preferably has area dimensions greater than the inner area dimensions of the frame 14. For example, if the frame 14 has a circular shape, the diameter of the circular cushion is greater than the inner diameter of the frame 14. Similarly, if the frame 14 has a rectangular shape, the length and width of the cushion 60 is greater than the inner length and width, respectively, of the frame 14. The difference in the respective dimensions of the cushion 60 and inner dimensions of the frame 14 can vary. A 6" difference in length and a 6" difference in width has been found to be satisfactory.

Figure 10:
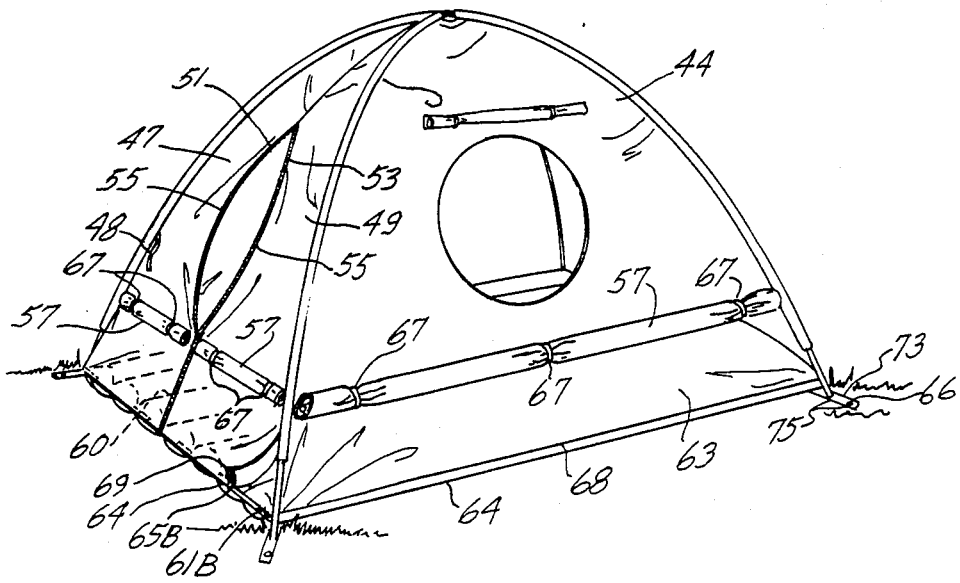
FIG. 10 is an oblique elevational perspective view as in FIG. 2 showing a shelter of the apparatus of FIG. 9 being supported on land.

The shelter assembly 40 also comprises means for holding a bottom portion of the cover proximate the edge 64 of the cushion 60. The holding means includes a plurality of pole retainers 66 for securing the pole members 42 proximate the cushion 60. Each pole retainer 66 comprises a tab 73 having one or more eyelets 75 is therein for receiving the struts. The pole retainers 66 are attached to the corners of the cushion 60 and are located proximate the anchor means 34 when the cushion 60 is retained by the frame 14. The holding means also includes means 68 for fastening at least a portion of the edge 64 of the cushion 60 to a corresponding portion of a bottom edge 63 of the cover 44. Exemplary fastening means 68 are zippers and velcro fasteners having a first side member attached along the portion of the edge 64 of the cushion 60 and a complimentary second side member attached to a corresponding portion of the bottom edge 63 of the cover 44. In FIG. 2, the fastening means 68 is schematically represented as a zipper having first and second side members 61A and 65A, respectively. In FIG. 10, the fastening means is schematically represented as a velcro fastener having first and second side members 61B and 65B, respectively.

The cover 44, entrance 46, and removable cover means 52 are made from a suitable, sturdy material. Since it is desirable to keep the inside of the shelter dry, this material is preferably also water repellant. Exemplary materials include, but are not limited to, plastics (e.g. nylon, PVC), cotton, and blends thereof. Water repellant nylon is preferred because it is light, airy, and translucent.

Each window 50 is either manufactured from a transparent, flexible, material (e.g., plastic) or from a suitable netting material (e.g., nylon netting) is simply an opening, preferably reinforced for structural integrity, in the cover 44. In FIGS. 9 and 10, the windows 50 are manufactured from a mosquito type netting material 58.

The cushion 60, like the frame 14 and flexible member 30, is fabricated from a suitable, sturdy water impervious material such as PVC. Although a PVC thickness of 20 mil is satisfactory for the cushion 60, it is preferred that the cushion 60 be constructed from 28 mil thick PVC.

The struts 42 are manufactured from a flexible, sturdy material such as fiber glass or plastic. An exemplary elastic used to axially bias the strut segments is shock cord.

To enable the apparatus 10 to be quickly propelled in water it is preferred that the frame 14 be provided with a sleeve member 72. The sleeve member 72 is adapted to fit tightly around an elongate member 76 which is inserted therethrough. The sleeve member 72 extends through the frame 14 and is sealingly joined thereto. The sleeve member 72 traverses the frame 14 at an angle, A, such that the end of the elongate member exterior to the frame is capable of being submerged when the apparatus 10 is floating on water. The angle A can be up to 90°. Exemplary angles are between 30° and 60°. A 45° angle has been found to be preferred. A conduit 74 is preferably positioned in the sleeve member 72 in order to prevent damage to the sleeve member 72 because of axial or radial movement of the elongate member 76. The conduit 74 optionally has flange 77 at an end 79 thereof to prevent the conduit 74 from slipping axially through the sleeve member 72. The elongate member 76 is provided with a propeller 78 at the end thereof as well as a motor 80 for driving the propellor 78.

To prevent puncturing the frame 14, the end 43 of each strut 42 is preferably removably inserted into a recepticle 82 having a smooth outer surface and a round bottom 88. The mouth 84 of the recepticle 82 optionally has a flange 86 to facilitate the insertion and removal of strut 42 from the recepticle 82. Exemplary materials from which the recepticle 82 is fabricated include, but are not limited to, plastic and metal.

The device of the present invention is employed for providing shelter on land as well as on water. In accordance with this method, the buoyant vehicle 12, as described above, is selected. The inflatable cushion 60 is inserted into the vehicle 12 and, as noted above, covers the floor 30 thereof and is retained therein against the floor 30 by the frame 14. A plurality of struts 42 are inserted at one end thereof into the anchor means 34 for use as pole members. The struts 42 extend upwardly from anchor means 34 and across the floor 30. A flexible cover 44 is attached to the struts 42. The opposite end of each strut 42 is curved downwardly and inserted into the anchor means 34, the struts 42 being anchored at opposite sides of the frame 12. The cover 44 extends to proximate the perimeter 32 of the floor 30. The cover 44 forms a shelter 40 and has an entrance means 46 for the occupants of the shelter. A bottom portion 63 of the cover 42 is secured proximate an edge 64 of the cushion 60. This device 10 can be used as a houseboat to provide both locomotion and shelter on water. To convert the houseboat into a tent, the cushion 60, the struts 42, and the cover 44 are removed from the vehicle 12 and placed on land with the bottom portion 63 of the cover 44 proximate the edge 64 of the cushion 60.

To prevent movement of the shelter apparatus 40 due to high gusts of wind, the struts 42 are preferably inserted into the ground. Prior to this insertion, receptacles 82 are removed from ends 43 of each strut 42. The ends of the struts 42 are then reinserted into corresponding hollow spikes 83. Each hollow spike 83 has a pointed tip 90 to facilitate penetration into the ground. A flange 87 is preferably provided at mouth 85 of the spike 83 to facilitate the insertion and removal of the spike 83 into the ground. Preferably, a stake (not shown) is also inserted into the ground through an eyelet 75 in each pole retainer 66 to further secure the shelter apparatus 40.

In addition to the above utilities, the cushion 60 can be detached from the cover 44 and employed as an air mattress in aquatic recreational activities.

The apparatus 10 of the present invention has many significant advantages compared to prior art recreational equipment. The apparatus 10 is versatile in that it is capable of use as a houseboat on water, as a tent on land, as well as an air mattress for use in conjunction with aquatic activities. Because of this versatility, the apparatus 10 minimizes the amount of recreational gear required in order to fully participate in different recreational past times. Accordingly, the apparatus 10 of the present invention reduces the cost a consumer must incur in order to outfit himself with the necessary recreational equipment. Furthermore, the amount of gear necessary to trudge along for use in these activities is significantly reduced.

Although the present invention has been described in considerable detail with reference to certain preferred versions thereof, other versions are possible. Therefore, the spirit and scope of the appended claims should not necessarily be limited to the description of preferred versions contained herein.

What is claimed is:

1. A convertible, inflatable shelter apparatus for use on land and in a body of water, the apparatus comprising:

(a) a buoyant vehicle comprising:

(i) an inflatable frame comprising an outer member;

(ii) a flexible member forming a floor for the vehicle, the flexible member having a perimeter, the perimeter of the flexible member being sealingly attached to the frame; and (iii) anchor means on the frame for holding a spaced plurality of cylindrical members; and (b) a shelter assembly comprising:

(i) a plurality of elongated struts, a cylindrical portion of each strut being removably held by the anchor means, each strut extending upwardly therefrom and across the floor;

(ii) a flexible cover supported by the struts and extending to proximate the perimeter of the floor, the cover having entrance means for an occupant of the shelter;

(iii) an inflatable cushion for covering the floor, the cushion being removably retained against the floor by the frame; and (iv) means for holding a bottom portion of the cover proximate an edge of the cushion, wherein when the cushion, the struts, and the cover are removed from the vehicle, the holding means is capable of maintaining the bottom portion of the cover proximate the cushion with the struts extending upwardly therefrom and across the cushion, the cushion and the struts being capable of being supported on the land apart from the vehicle for forming a tent.

2. The apparatus of claim 1 wherein the holding means comprises means or locating the bottom portion of the cover proximate the cylindrical portion of at least one strut; and means for securing at least some of the struts proximate the cushion, the securing means being located proximate the anchor means when the cushion is being retained by the frame.

3. The apparatus of claim 1 wherein the holding means comprises means for fastening at least a portion of the edge of the cushion to a corresponding portion of a bottom edge of the cover.

4. The apparatus of claim 1 wherein each strut comprises: (a) a plurality of tubular segments, each segment having two ends, wherein the ends of adjacent segments are removably and telescopically joined; and (b) an elastic cord for biasing the segments axially together, the cord being fixed to opposite ends of the strut and passing through the segments.

5. The apparatus of claim 1 wherein the cover further comprises at least one channel for insertion of a strut therein.

6. The apparatus of claim 1 wherein the cover has a window therein, and the apparatus further comprises means for removably covering the window.

7. The apparatus of claim 1 wherein the entrance means comprises two flaps, the two flaps having corresponding edges, the apparatus further comprising means for holding the two edges of the flaps proximate one another.

8. The apparatus of claim 1 further comprising means for directing water run-off from the cover to a location exterior to the outer member of the inflatable frame.

9. The apparatus of claim 1 wherein the frame has a rectangular shape and the outer member is cylindrical.

10. The apparatus of claim 9 wherein the outer member of the frame has a pair of longitudinal sides and a pair of lateral sides, and portions of each longitudinal side extend beyond the lateral sides of the frame, each extended portion forming a conical protrusion.

11. The apparatus of claim 1 wherein tbe frame further comprises a sleeve member adapted for insertion of an elongated member therethrough, the sleeve member extending through the frame and sealingly joined thereto for permitting an elongated member to be inserted into the water from inside the vehicle while preventing the passage of water into the vehicle.

12. The apparatus of claim 1 wherein the outer member comprises two circumferential compartments.

13. A convertible, inflatable shelter apparatus for use on land and in a body of water, the apparatus comprising:

(a) a buoyant vehicle comprising:

(i) an inflatable frame comprising a cylindrical outer member having a substantially rectangular shape, the frame having a pair of longitudinal sides and a pair of lateral sides, wherein portions of each longitudinal side extend beyond the lateral sides of the frame, each extended portion forming a conical protrusion;

(ii) a flexible member forming a floor for the vehicle, the flexible member having a perimeter, the perimeter of the flexible member being sealingly attached to the frame; and (iii) anchor means on the frame for holding a spaced plurality of cylindrical members; and (b) a shelter assembly comprising:

(i) a plurality of flexible elongated struts, a cylindrical portion of each strut being removably held by the anchor means, each strut extending upwardly therefrom and across the floor;

(ii) a flexible cover supported by the struts and extending to proximate the perimeter of the floor, the cover having entrance means for an occupant of the shelter, and a plurality of channels for insertion of each strut therein;

(iii) an inflatable cushion for covering the floor, the cushion being removably retained against the floor by the frame; and (iv) means for holding a bottom portion of the cover proximate an edge of the cushion, wherein, when the cushion, the struts, and the cover are removed from the vehicle, the holding means is capable of maintaining the cover proximate the cushion when the cushion and the struts are supported on the land apart from the vehicle for forming a tent.

14. The apparatus of claim 1 wherein the holding means comprises means for locating the bottom portion of the cover proximate the cylindrical portion of at least one strut; and means for securing at least some of the struts proximate the cushion, the securing means being located proximate the anchor means when the cushion is being retained by the frame.

15. The apparatus of claim 13 wherein the holding means comprises means for fastening at least a portion of the edge of the cushion to a corresponding portion of a bottom edge of the cover.

16. The apparatus of claim 15 wherein the fastening means comprises a zipper, the zipper having a first side member attached along the portion of the edge of the cushion, and a complementary second side member attached to the corresponding portion of the bottom edge of the cover.

17. The apparatus of claim 15 wherein the fastening means comprises a velcro fastener, the velcro fastener having a first side member attached along the portion of the edge of the cushion, and a complementary second side member attached to the corresponding portion of the bottom edge of the cover.

18. The apparatus of claim 13 wherein the entrance means comprises two flaps, the two flaps having corresponding edges, the apparatus further comprising means for holding the two edges of the flaps proximate one another.

19. The apparatus of claim 13 further comprising means for directing water run-off from the cover to a location exterior to the outer member of the inflatable frame.

20. A method for providing shelter in a body of water, and then on land, the method comprising the steps of:

(a) selecting a buoyant vehicle comprising:

(i) an inflatable frame comprising an outer member;

(ii) a flexible member forming a floor for the vehicle, the flexible member having a perimeter, the perimeter of the flexible member being sealingly attached to the frame; and (iii) anchor means on the frame for holding a spaced plurality of cylindrical members;

(b) inserting an inflatable cushion into the vehicle, the cushion covering the floor and being removably retained against the floor by the frame;

(c) inserting one cylindrical end of a plurality of struts into the anchor means, the struts extending upwardly therefrom and across the floor;

(d) attaching a flexible cover to the struts, the cover extending to proximate the perimeter of the floor for forming a shelter, the cover having entrance means for an occupant of the shelter;

(e) extending an opposite cylindrical end of each strut across the floor;

(f) inserting the opposite end of each strut into the anchor means;

(g) securing a bottom portion of the cover proximate an edge of the cushion to thereby form a floating tent shelter;

(h) removing the cushion, the struts, and the cushion from the vehicle; and (i) placing the cushion and the struts on the land to thereby form a tent with the bottom portion of the cover secured proximate the edge of the cushion, thereby forming a shelter on land apart from the vehicle and subsequent to the formation of the floating shelter.

21. A method for converting a land-supported shelter assembly for use in a body of water, the shelter assembly comprising a tent having a cover supported by a spaced plurality of struts, the struts extending upwardly from the land and across a floor region thereof, the cover extending to proximate the floor region and having entrance means for an occupant of the tent, the method comprising the steps of:

(a) removing the shelter assembly from the land;

(b) providing a buoyant vehicle comprising:

(i) an inflatable frame comprising an outer member;

(ii) a flexible member forming a floor of the vehicle, the flexible member having a perimeter, the perimeter of the flexible member being sealingly attached to the frame; and (iii) anchor means on the frame for holding a spaced plurality of cylindrical members;

(c) inserting one cylindrical end of each of the struts into the anchor means;

(d) extending an opposite cylindrical end of each strut across the floor of the vehicle; and (e) inserting the opposite cylindrical end of each strut into the anchor means to thereby form a floating tent shelter.

22. The method of claim 21 wherein the land-supported shelter assembly includes an inflatable cushion, the method further comprising the steps of:

(a) inserting the inflatable cushion into the vehicle to cover the floor thereof; and (b) securing the bottom portion of the cover proximate the edge of the cushion.

* * * * *